US010008172B2

(12) United States Patent
Li et al.

(10) Patent No.: US 10,008,172 B2
(45) Date of Patent: Jun. 26, 2018

(54) DEVICES AND METHODS FOR REDUCING OR ELIMINATING MURA ARTIFACT USING DAC BASED TECHNIQUES

(71) Applicant: APPLE INC., Cupertino, CA (US)

(72) Inventors: Yingxuan Li, Saratoga, CA (US); Weijun Yao, San Jose, CA (US); Wei H. Yao, Palo Alto, CA (US); Kingsuk Brahma, San Francisco, CA (US); Hyunwoo Nho, Stanford, CA (US)

(73) Assignee: APPLE INC., Cupertino, CA (US)

( * ) Notice: Subject to any disclaimer, the term of this patent is extended or adjusted under 35 U.S.C. 154(b) by 961 days.

(21) Appl. No.: 14/276,146

(22) Filed: May 13, 2014

(65) Prior Publication Data

US 2015/0332638 A1 Nov. 19, 2015

(51) Int. Cl.
*G09G 3/36* (2006.01)

(52) U.S. Cl.
CPC ..... *G09G 3/3688* (2013.01); *G09G 3/3648* (2013.01); *G09G 3/3655* (2013.01); *G09G 3/3696* (2013.01); *G09G 2300/0426* (2013.01); *G09G 2310/027* (2013.01); *G09G 2310/0291* (2013.01); *G09G 2320/029* (2013.01); *G09G 2320/0233* (2013.01); *G09G 2320/0276* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,554,517 | B2 | 6/2009 | Baum et al. | |
| 7,589,983 | B1 * | 9/2009 | Lin | H02M 3/33515 323/367 |
| 8,269,803 | B2 | 9/2012 | Yoo et al. | |
| 8,373,729 | B2 | 2/2013 | Lee et al. | |
| 8,416,232 | B2 | 4/2013 | Nam et al. | |
| 2008/0204439 | A1 * | 8/2008 | Morita | G09G 3/3688 345/209 |
| 2008/0284794 | A1 * | 11/2008 | Wang | G09G 3/3648 345/618 |
| 2009/0213049 | A1 | 8/2009 | McCreary | |
| 2011/0242140 | A1 * | 10/2011 | Lee | G09G 3/3648 345/690 |
| 2013/0141343 | A1 * | 6/2013 | Yu | G06F 3/0412 345/173 |

* cited by examiner

*Primary Examiner* — Robin Mishler
(74) *Attorney, Agent, or Firm* — Fletcher Yoder PC

(57) ABSTRACT

Devices and methods for reducing or eliminating image artifacts are provided. By way of example, a display panel includes a pixels including pixel electrodes configured to receive an image data signal, and common electrodes (VCOMs) configured to receive a common voltage signal. The display panel includes a source driver, which includes a first digital to analog converter (DAC) configured to generate a gamma voltage signal to provide a first adjustment to the image data signal, and a second DAC configured to generate an error correction voltage signal to provide a second adjustment to the image data signal. The second adjustment is configured to adjust the image data signal to compensate for an operational characteristic difference between row pixels and column pixels of the display panel. The source driver includes an output buffer to supply the image data signal to the pixel electrodes.

6 Claims, 11 Drawing Sheets

DEVICES AND METHODS FOR REDUCING OR ELIMINATING MURA ARTIFACT USING DAC BASED TECHNIQUES

BACKGROUND

The present disclosure relates generally to electronic displays and, more particularly, to electronic displays with reduced or eliminated mura artifacts.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays commonly appear in electronic devices such as televisions, computers, and phones. One type of electronic display, known as a liquid crystal display (LCD), displays images by modulating the amount of light allowed to pass through a liquid crystal layer within pixels of the LCD. In general, LCDs modulate the light passing through each pixel by varying a voltage difference between a pixel electrode and a common electrode. This creates an electric field that causes the liquid crystal layer to change alignment. The change in alignment of the liquid crystal layer causes more or less light to pass through the pixel. By changing the voltage difference (often referred to as a data signal) supplied to each pixel, images are produced on the LCD.

Conventionally, the common electrodes of the pixels of the LCD are all formed from a single common voltage layer (VCOM). Thus, to the extent that undesirable bias voltages or voltage perturbations may occur in the VCOM, any resulting negative effects would be distributed over the entire LCD. When an LCD includes multiple VCOMs, however, it is believed that undesirable bias voltages or voltage perturbations may occur differentially on the various VCOMs. These differential bias voltages or voltage perturbations could produce visible artifacts known as muras, or largely permanent display screen artifacts.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to systems, methods, and devices for reducing or eliminating mura artifacts in electronic displays, such as liquid crystal displays (LCDs) or organic light emitting diode (OLED) displays. In a particular example, it is believed that certain artifacts or muras could arise in an LCD having multiple distinct common voltage layers (VCOMs). For example, an LCD with VCOMs generally arranged in alternating rows and columns may exhibit a vertical stripe feature of merit (VSFOM). The VSFOM may appear as alternating light and dark vertical stripes along the LCD.

Various embodiments of the present disclosure may reduce and/or substantially eliminate image artifacts (e.g., VSFOM) on electronic displays. By way of example, an electronic device may include a display panel. The display panel includes a number of pixels including pixel electrodes configured to receive an image data signal, and a number of common electrodes (VCOMs) configured to receive a common voltage signal. The display panel includes a gate driver configured to provide an activation signal to the number of pixel electrodes and a source driver. The source driver includes a first digital to analog converter (DAC) configured to generate a gamma voltage signal to provide a first adjustment to the image data signal, and a second DAC configured to generate an error correction voltage signal to provide a second adjustment to the image data signal. The second adjustment is configured to adjust the image data signal to compensate for an operational characteristic difference between row pixels of the number of pixels and column pixels of the number of pixels. The source driver includes an output buffer configured to supply the image data signal to the number of pixel electrodes. The image data signal includes the first adjustment and the second adjustment.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
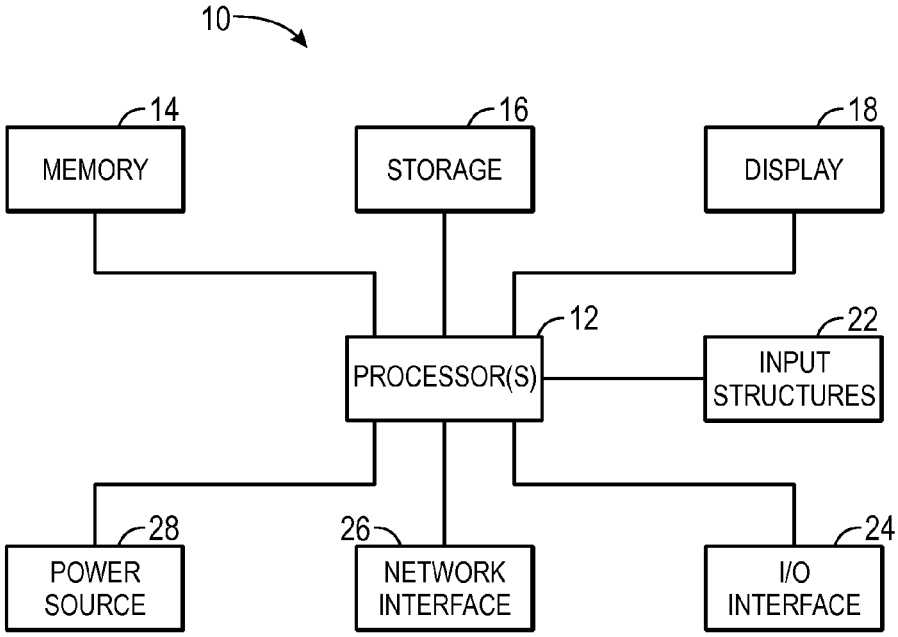
FIG. 1 is a schematic block diagram of an electronic device with a liquid crystal display (LCD) having in-cell touch sensor components, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to liquid crystal displays (LCDs) and electronic devices incorporating LCDs that employ touch sensor components within display pixel cells ("in-cell"). Specifically, in-cell touch technology (e.g., in-cell touch charge sensing) may be susceptible to mura artifacts becoming apparent on the LCD. In a particular example, it is believed that certain artifacts or muras could arise in an LCD having multiple distinct common voltage layers (VCOMs). For example, an LCD with VCOMs generally arranged in alternating rows and columns may exhibit a vertical stripe feature of merit (VSFOM). Specifically, during the time the thin-film transistor (TFT) is switched to an "OFF" state, the voltage on the gate of the TFT may begin to fall, and additional charge may be stored on a storage capacitor $C_{ST}$ of the pixel to hold a charge on the pixel electrode of the pixel. Moreover, because the VCOM electrodes may exhibit different resistance values, the charge, and by extension, the voltage stored on the storage capacitor $C_{ST}$ may be different for the row and column pixels of the LCD. This difference may create a patterned voltage imbalance between the row pixels and column pixels, and may manifest as undesirable visible artifacts, known as muras, on the LCD.

Accordingly, various embodiments of the present disclosure may reduce and/or substantially eliminate artifacts (e.g., VSFOM), including those due to differential voltages or voltage perturbations on multiple distinct VCOMs. In certain embodiments, the mura artifacts may be reduce and/or substantially eliminated by providing a display source driver that includes a first digital to analog converter (DAC) used to generate a gamma voltage signal to compensate for gamma associated with image data provided to the display, and a second DAC used to generate a VSFOM voltage signal to compensate for error voltages that may be associated with the row pixels and column pixels of the display. The source driver may also include an output buffer used to sum the gamma voltage signal and the VSFOM voltage signal, and to supply an image data driving signal to the pixels of the display adjusted to compensate for gamma and VSFOM.

As used herein, "row" may refer to at least one axis of an array or matrix of components (e.g., row VCOM electrodes and/or row pixels) on which the components may be substantially aligned. Similarly, "column" may refer to at least one other axis of the array or the matrix of components that may intersect and/or extend in a direction perpendicular to the row axis, and on which other similar components (e.g., column VCOM electrodes and/or column pixels) may be substantially aligned. That is, the "rows" and the "columns" may be respectively understood to refer to any one of at least two axes, in which the two axes are substantially perpendicular. Additionally, the term "mura" may refer to a visual artifact that may remain at least partially visible when the display is on. The nature of mura artifacts may depend on the arrangement of the internal components of the display. For example, when VCOM electrodes are generally arranged in rows and columns as discussed above, the resulting mura artifact(s) may form what may be referred to as a vertical stripe feature of merit (VSFOM), or a manifestation of light and/or dark stripes oriented parallel to, for example, the source lines of the display. Specifically, it should be appreciated that mura artifact and/or VSFOM may manifest as light and/or dark stripes that may appear vertically and/or horizontally with respect to, for example, the viewpoint of a user of the display.

Figure 2:
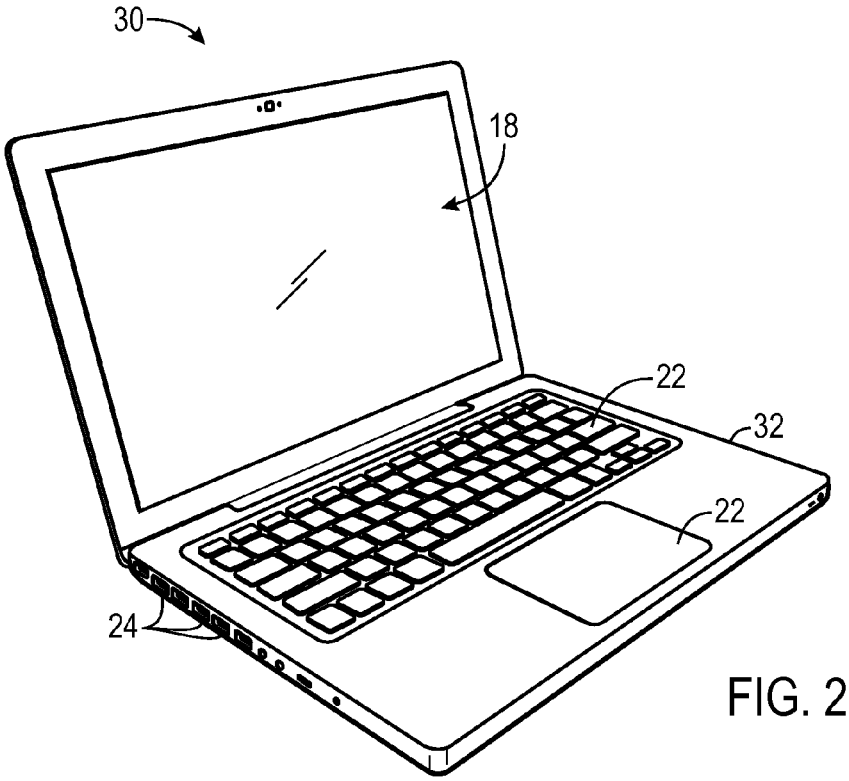
FIG. 2 is a perspective view of a notebook computer representing an embodiment of the electronic device of FIG. 1.
Figure 3:
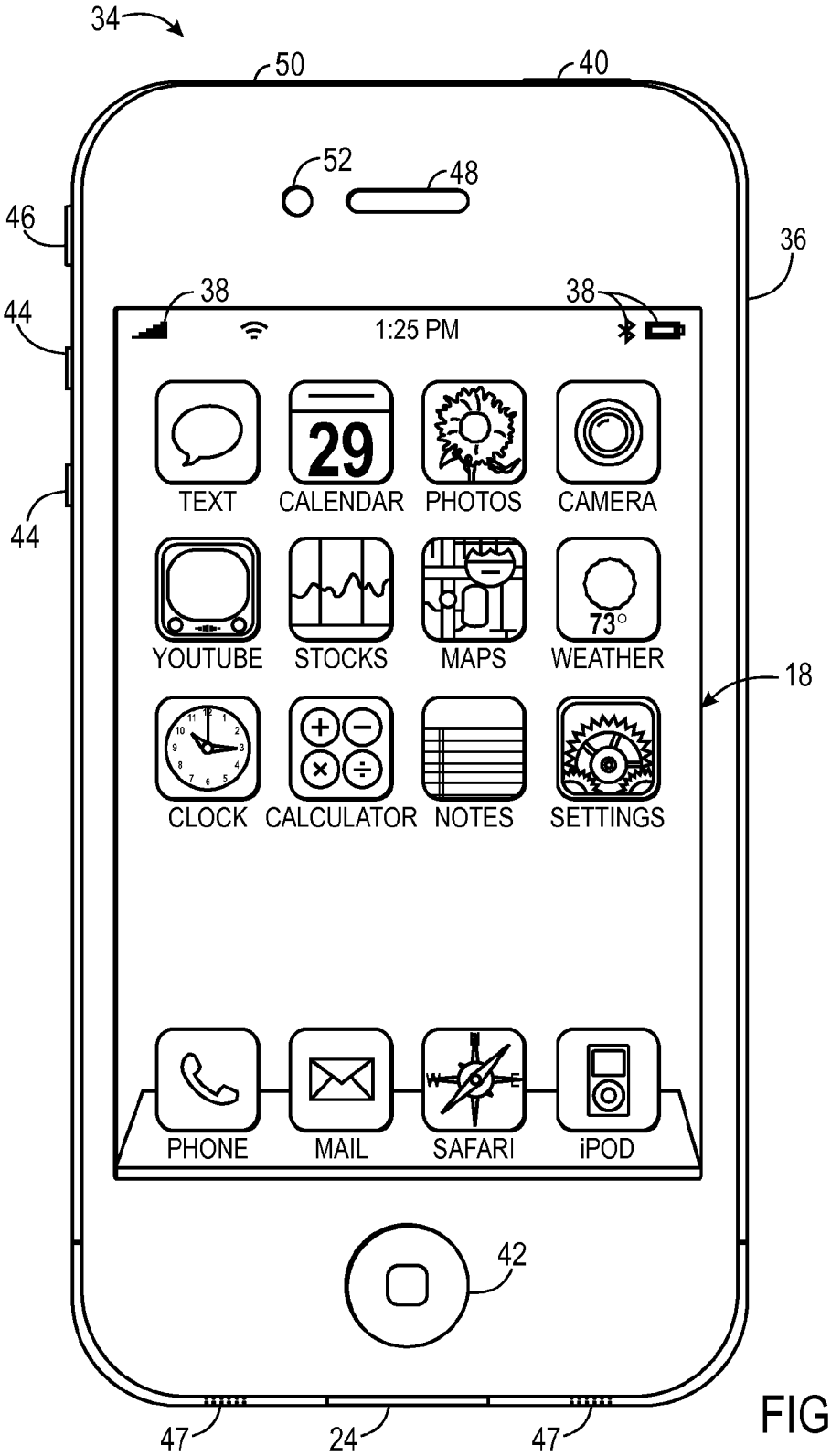
FIG. 3 is a front view of a hand-held device representing another embodiment of the electronic device of FIG. 1.

With the foregoing in mind, a general description of suitable electronic devices that may employ electronic touch screen displays having in-cell touch components and are useful in reducing and/or substantially eliminating the mura artifacts that may become apparent on the display will be provided below. In particular, FIG. 1 is a block diagram depicting various components that may be present in an electronic device suitable for use with such a display. FIGS. 2 and 3 respectively illustrate perspective and front views of suitable electronic device, which may be, as illustrated, a notebook computer or a handheld electronic device.

Turning first to FIG. 1, an electronic device 10 according to an embodiment of the present disclosure may include, among other things, one or more processor(s) 12, memory 14, nonvolatile storage 16, a display 18 having in-cell touch sensor components, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

By way of example, the electronic device 10 may represent a block diagram of the notebook computer depicted in FIG. 2, the handheld device depicted in FIG. 3, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to perform various algorithms for responding appropriately to a user touch on the display 18. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12 to enable the electronic device 10 to provide various functionalities.

The display 18 may be a touch screen liquid crystal display (LCD), which may allow users to interact with a user interface of the electronic device 10. Various touch sensor components, such as touch sense and/or touch drive electrodes may be located within display pixel cells of the display 18. As mentioned above, in-cell touch sensor components may include integrated display panel components serving a secondary role as touch sensor components. As such, it should be appreciated that the in-cell touch sensor components may be formed from a gate line of the display, a pixel electrode of the display, a common electrode of the display, a data line of the display, or a drain line of the display, or some combination of these elements.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on display 18. The display 18 may be relatively thin and/or bright, as the in-cell touch components may not require an additional capacitive touch panel overlaid on it.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones. As mentioned above, the display 18 may be relatively thin and/or bright, as the in-cell touch components may not require an additional capacitive touch panel overlaid on it.

Figure 4:
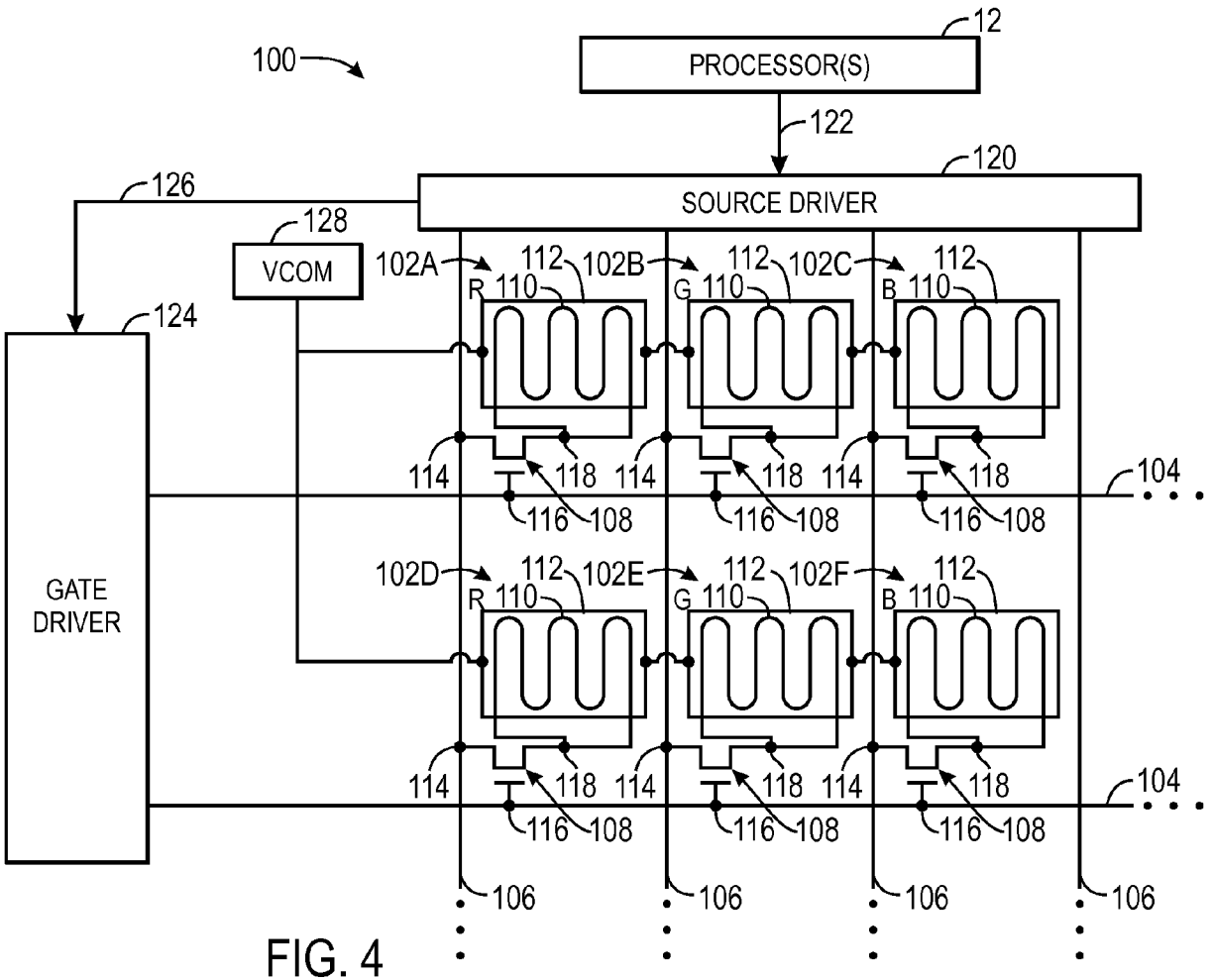
FIG. 4 is a circuit diagram of switching a display circuitry of pixels of an LCD including a source driver, in accordance with an embodiment.

FIG. 4 generally represents a circuit diagram of certain components of the display 18 in accordance with some embodiments. In particular, the pixel array 100 of the display 18 may include a number of unit pixels 102 disposed in a pixel array or matrix. In such an array, each unit pixel 102 may be defined by the intersection of rows and columns, represented by gate lines 104 (also referred to as scanning lines), and data lines 106 (also referred to as data lines), respectively. Although only 6 unit pixels 102, referred to individually by the reference numbers 102*a*-102*f*, respectively, are shown for purposes of simplicity, it should be understood that in an actual implementation, each data line 106 and gate line 104 may include hundreds or thousands of such unit pixels 102. Each of the unit pixels 102 may represent one of three subpixels that respectively filters only one color (e.g., red, blue, or green) of light through, for example, a color filter. For purposes of the present disclosure, the terms "pixel," "subpixel," and "unit pixel" may be used largely interchangeably.

In the presently illustrated embodiment, each unit pixel 102 may include a thin film transistor (TFT) 108 for switching a data signal stored on a respective pixel electrode 110. The potential stored on the pixel electrode 110 relative to a potential of a common electrode 112 (e.g., creating a liquid crystal capacitance $C_{LC}$), which may be shared by other pixels 102, may generate an electrical field sufficient to alter the arrangement of liquid crystal molecules (not illustrated in FIG. 4). In the depicted embodiment of FIG. 4, a source 114 of each TFT 108 may be electrically connected to a data line 106 and a gate 116 of each TFT 108 may be electrically connected to a gate line 104. A drain 118 of each TFT 108 may be electrically connected to a respective pixel electrode 110. Each TFT 108 may serve as a switching element that may be activated and deactivated (e.g., turned "ON" and turned "OFF") for a predetermined period of time based on the respective presence or absence of a scanning signal on the gate lines 104 that are applied to the gates 116 of the TFTs 108.

When activated, a TFT 108 may store the image signals received via the respective data line 106 as a charge upon its corresponding pixel electrode 110. As noted above, the image signals stored by the pixel electrode 110 may be used to generate an electrical field between the respective pixel electrode 110 and a common electrode 112. This electrical field may align the liquid crystal molecules to modulate light transmission through the pixel 102. Furthermore, although not illustrated, it should be appreciated that each unit pixel 102 may also include a storage capacitor $C_{ST}$ that may used to sustain the pixel electrode voltage (e.g., $V_{pixel}$) during the time in which the TFTs 108 may be switch to the "OFF" state.

The display 18 also may include a source driver integrated circuit (IC) 120, which may include a chip, such as a processor or application specific integrated circuit (ASIC) that controls the display pixel array 100 by receiving image data 122 from the processor(s) 12, and sending corresponding image signals to the unit pixels 102 of the pixel array 100. The source driver 120 may also provide timing signals 126 to the gate driver 124 to facilitate the activation/deactivation of individual rows of pixels 102. In other embodiments, timing information may be provided to the gate driver 124 in some other manner. The display 18 may or may not include a common voltage (VCOM) source 128 to provide a common voltage (VCOM) voltage to the common electrodes 112. In certain embodiments, the VCOM source 128 may supply a different VCOM to different common electrodes 112 at different times. In other embodiments, the common electrodes 112 all may be maintained at the same potential or similar potential.

Figure 5:
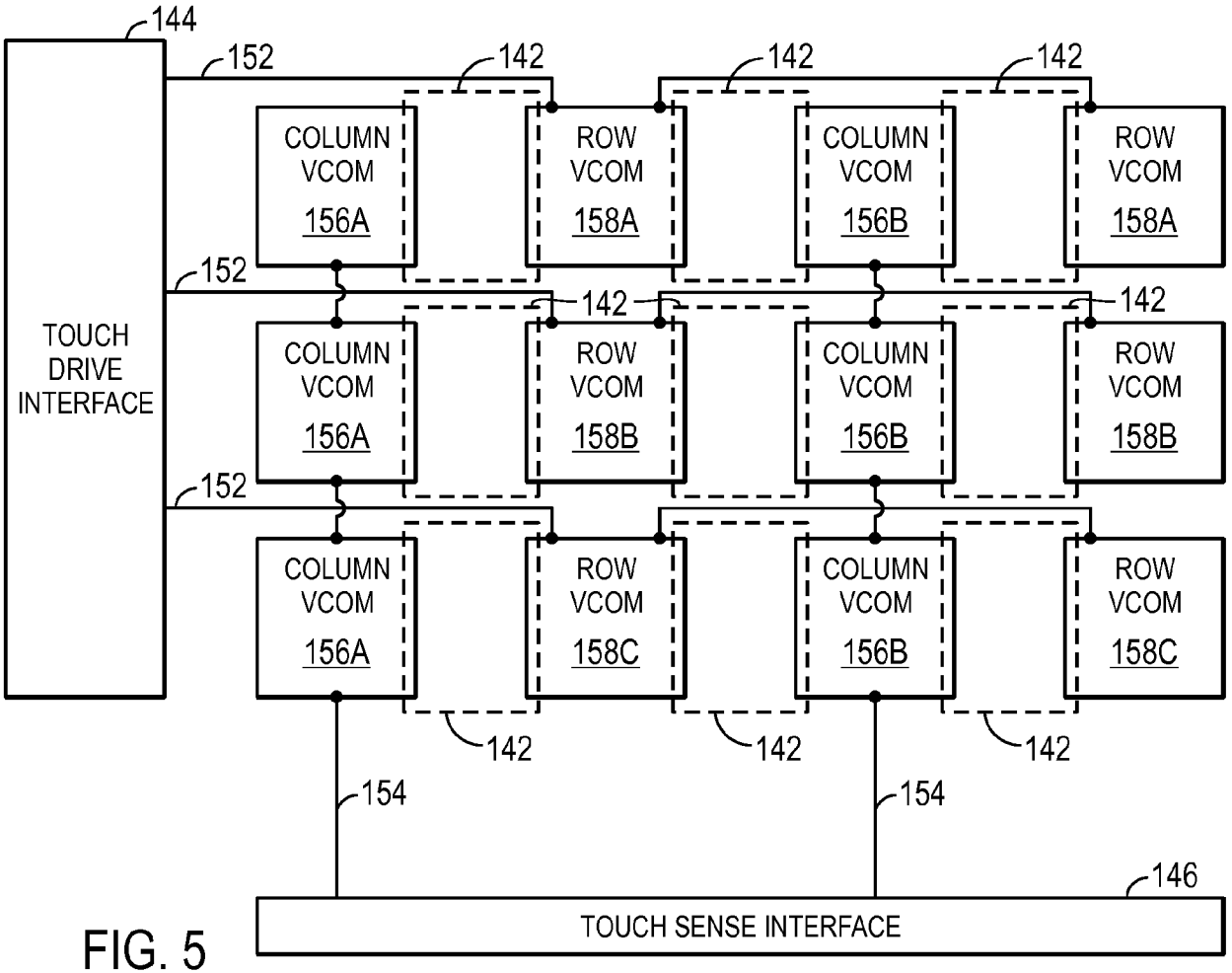
FIG. 5 is a schematic block diagram of multiple VCOMs of the LCD, in accordance with an embodiment.

In certain embodiments, as illustrated in FIG. 5, a touch pixel array 140 may include an N×M of touch pixels 142 (e.g., a 6×10 matrix or other size matrix of touch pixels 142). These touch pixels 142 arise due to interactions between touch drive electrodes 152 and touch sense electrodes 154. It should be noted that the terms "lines" and "electrodes" as sometimes used herein simply refers to conductive pathways, and is not intended to be limited to structures that are strictly linear. Rather, the terms "lines" and "electrodes" may encompass pathways that change direction, of different size, shape, materials, and regions. The touch drive electrodes 152 may be driven, for example, by one or more touch drive signals.

The sense lines 154 may respond differently to the touch drive signals when an object, such as a finger, is located near the confluence of a given touch drive electrode 152 and a given touch sense electrode 154. The presence of the object may be "seen" by the touch pixel 142 that may result at an intersection of the touch drive electrode 152 and the touch sense electrode 154. That is, the touch drive electrodes 152 and the touch sense electrodes 154 may form capacitive sensing nodes, or more aptly, the touch pixels 142. It should be appreciated that the respective touch drive electrodes 152 and touch sense electrodes 154 may be formed, for example, from dedicated touch drive electrodes 152 and/or dedicated touch sense electrodes 154, and/or may be formed from one or more gate lines 104 of the display 18, one or more pixel electrodes 110 of the display 18, one or more common electrodes 112 of the display 18, or some combination of these elements.

For example, as further illustrated in FIG. 5, the touch drive electrodes 152 and touch sense electrodes 154 may include column VCOM 156 electrodes and row VCOM 158 electrodes. It should be appreciated that although FIG. 5 depicts only a few column VCOMs 156A and 156B and row VCOMs 158, an actual implementation of the display 18 may include any suitable number of column VCOMs 156 and row VCOMs 158. As previously noted, the column VCOMs 156 and row VCOMs 158 may gather touch sense information when operating in what may be referred to herein as a touch mode of operation. Though the column VCOMs 156 and row VCOMs 158 may be supplied the same direct current (DC) bias voltage, for example, in some embodiments, different alternating current (AC) voltages may be supplied and/or received on VCOMs 156 and 158 at substantially different times. For example, as previously noted, the display 18 may be configured to switch between two modes of operation: a display mode of operation and the touch mode of operation.

In the display mode, the column VCOMs 156 and the row VCOMs 158 may operate in the aforementioned manner, in which an electric field is generated between the column and row VCOMs 156 and 158 and respective pixel electrodes 110. The electric field may modulate the liquid crystal molecules to allow a certain amount of light to pass through the pixel. Thus, an image may be displayed on the display 18 in the display mode. On the other hand, in the touch mode, the row VCOM 158 and the column VCOM 156 may be configured to sense a touch on the display 18. In certain embodiments, a stimulus signal or voltage may be provided by the row VCOM 158. The column VCOM 156 may receive a touch signal and output the data to be processed, for example, by the processor(s) 12. The touch signal may be generated when a user, for example, touches and/or hover a finger nearby the display 18, creating capacitive coupling with a portion of the row VCOM 158 and a portion of the column VCOM 158. Thus, the portion of the column VCOM 156 may receive a signal indicative of the touch and/or hover. As will be further appreciated, due to certain characteristics and/or the arrangement of the column VCOMs 156 and the row VCOMs 158, the display 18 may be susceptible to displaying undesirable vertical striping mura artifacts (e.g., VSFOM).

Figure 6:
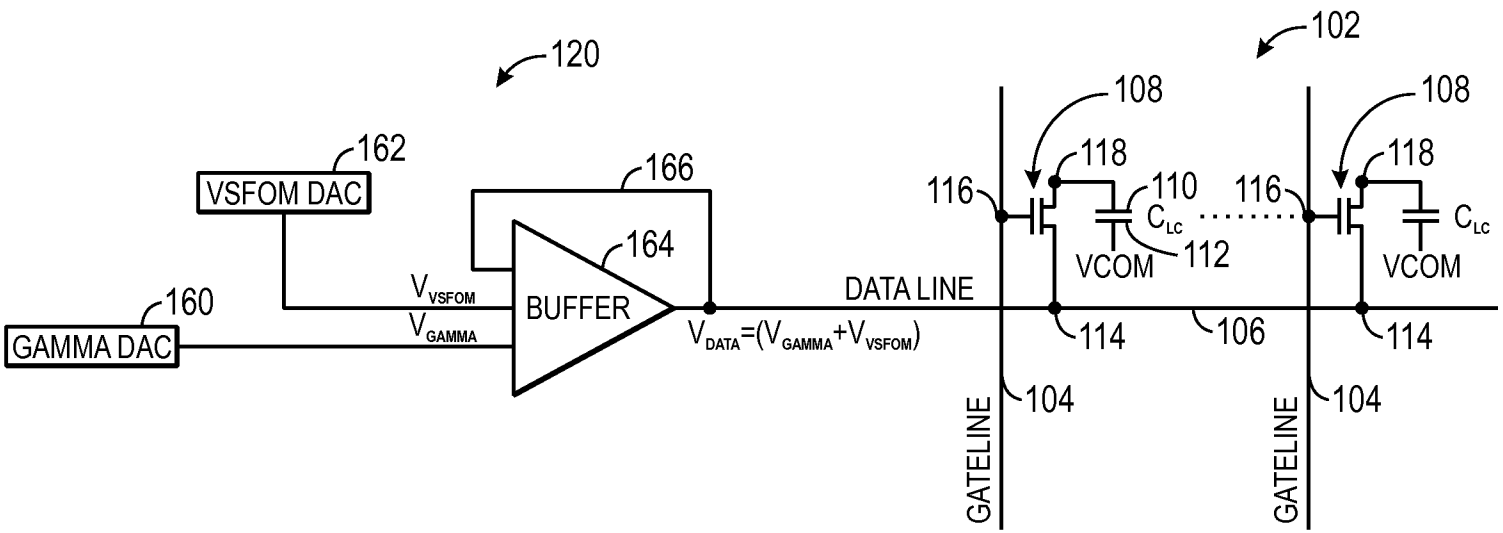
FIG. 6 is a block diagram of the source driver of FIG. 4 including a gamma DAC and a VSFOM DAC, in accordance with an embodiment.

Turning now to FIG. 6, which illustrates an embodiment of a circuit diagram (e.g., equivalent circuit) of the source driver 120 (e.g., data driver and/or column driver) that may be useful in reducing and/or substantially eliminating the occurrence of mura artifacts that may, for example, become apparent on the display 18. As depicted, the source driver 120 may include a gamma code digital-to-analog converter (gamma DAC) 160 and a VSFOM DAC 162, which may each be electrically coupled to an output buffer 164. The output buffer 164 in conjunction with, for example, the gamma DAC 160 and the VSFOM DAC 162 may be used to drive the data lines 106, and, by extension, the TFTs 108 in accordance with the present techniques.

In certain embodiments, the gamma DAC 160 may be any device used to generate one or more gamma correction voltages used to compensate for the nonlinear transmittance-voltage (e.g., luminance-voltage) characteristics of, for example, the liquid crystal (LC) molecules (not illustrated in FIG. 6) that may be included, for example, in the display 18. For example, the gamma DAC 160 may include a resistive DAC (R-DAC) or other similar DAC architecture that may be used to generate a gamma voltage value (e.g., gamma correction code) that may be supplied to output buffer 164 and used to compensate or invert, for example, the nonlinear transmittance-voltage characteristics that may be associated with the LC molecules (e.g., positioned between the pixel electrode 110 and the common electrode 112) of the display 18. Specifically, the gamma DAC 160 may be used to convert digital levels (e.g., gray levels) of the image data 122 into analog voltage data in accordance with, for example, a target gamma curve to produce "gamma-corrected" voltage data (e.g., $V_{GAMMA}$). As will be further appreciated, the "gamma-corrected" voltage data (e.g., $V_{GAMMA}$) generated by the gamma DAC 160 may be also used to scale one or more voltages (e.g., $V_{VSFOM}$) generated by the VSFOM DAC 162, in accordance with the present techniques.

For example, in some embodiments, in addition to providing the gamma DAC 160 to compensate for the nonlinear transmittance-voltage characteristics that may be associated with the display 18 (e.g., LCD), it may be useful to also provide the VSFOM DAC 162 to compensate for voltage distortions (e.g., error voltages) that may become present, for example, on the pixel electrodes 110. Specifically, the deactivation (e.g., switching to the "OFF" state) of the respective gates 116 of the TFTs 108 may cause the voltage on the row VCOMs 158 to also exhibit a transient drop due to, for example, capacitive coupling between the gate line 104 and the respective column and row VCOMs 156 and 158. It may then follow that the voltage on the row VCOMs 158, due to the configuration and physical proximity of the row VCOMs 158 to the gate line 104, may experience a longer rise time return to its original voltage value following the deactivation of the respective gates 116.

However, the voltage of the column VCOMs 156 may experience a less significant voltage drop (e.g., due to a difference in resistance between the column VCOMs 156 and the row VCOMs 158) in response to the deactivation of the respective gates 114 of the TFTs 108. As such, the voltage of the column VCOMs 156 may return to its original voltage at a rate faster than that of the row VCOMs 156, thus creating, for example, a voltage imbalance between the row pixels and the column pixels of the display 18. Specifically, as previously noted, during the time the TFTs 108 may switched to an "OFF" state, the voltage on the gate of the TFTs 108 may begin to fall, and additional charge may be stored on a storage capacitor $C_{ST}$ of the pixel 102 to hold a charge on the pixel electrodes 110 of the pixel 102. Moreover, because the column VCOM electrodes 156 and row VCOM electrodes 158 may exhibit different resistance values (e.g., $R_{CVCOM}$ and $R_{RVCOM}$), the pixel voltage (e.g., $V_{pixel}$) stored on the storage capacitor $C_{ST}$ may be different for the row and column pixels of the display 18. The imbalance and/or variation in pixel voltage (e.g., $V_{pixel}$) between the row pixels and the column pixels of the display 18 may result in different programmed values being stored to the row and column pixels of the display 18, even when the programmed values should be the same. This may become apparent on the display 18 as undesirable vertical striping mura artifacts (e.g., VSFOM).

Accordingly, the VSFOM DAC 162 may be provided specifically to compensate for the voltage distortions (e.g., voltage errors) on the column pixels (e.g., column pixel electrodes 112) and/or column VCOMs 156 of the display 18. In certain embodiments, the VSFOM DAC 162 may include a resistive DAC (R-DAC and/or R-2R DAC) (e.g., resistor string DAC), a capacitive DAC (CDAC), a binary-weighted DAC (BDAC), a serial DAC (SDAC), a combination thereof, or other similar DAC architecture that may be useful in outputting an analog voltage compensation value based on, for example, the voltage imbalance between the row pixels and the column pixels of the display 18.

As further depicted by FIG. 6, the output of the gamma DAC 160 and the output of the VSFOM DAC 162 may be input to the output buffer 164. Specifically, in some embodiments, the output buffer 164 may include an operational amplifier (OpAmp) (e.g., summing amplifier), which may include a feedback loop 166 and may be used to sum the gamma voltage (e.g., $V_{GAMMA}$) generated by the gamma DAC 160 and the VSFOM voltage compensation value (e.g., $V_{VSFOM}$) generated by the VSFOM DAC 162. The output $V_{DATA}$ (e.g., $V_{GAMMA}+V_{VSFOM}$) of the output buffer 164 may be used to drive the data line 106, and, by extension, the respective TFTs 108 to provide corrected image data to the respective pixel electrodes 110.

In certain embodiments, as will be further appreciated, a specific (e.g., local) VSFOM DAC 162 and output buffer 164 may be provided for each data line 106 to drive the individual column pixels (e.g., column pixel electrodes 112). However, in other embodiments, local VSFOM DACs 162 and output buffers 164 may be provided to drive individual column and row pixels (e.g., pixel electrodes 112). Specifically, as will be further illustrated with respect to FIGS. 8 and 9, in some embodiments, a global master VSFOM DAC 162 may be included, for example, as part of the source driver 120 to scale the voltage of each of the local VSFOM DACs 162 by a corresponding gamma code. Furthermore, it should be appreciated that the source driver 120 including the gamma DAC 160 and the VSFOM DAC 162 as illustrated in FIG. 6 may represent one embodiment of the source driver 120. For example, in other embodiments, particularly for a display 18 driven with both positive and negative polarity voltages, the VSFOM DAC 162 corresponding to each individual data line 106 (e.g., column data lines 106) may include individual VSFOM DACs 162 to respectively drive the positive polarity operation and the negative polarity operation of the unit pixels 102 of the display 18.

Figure 7:
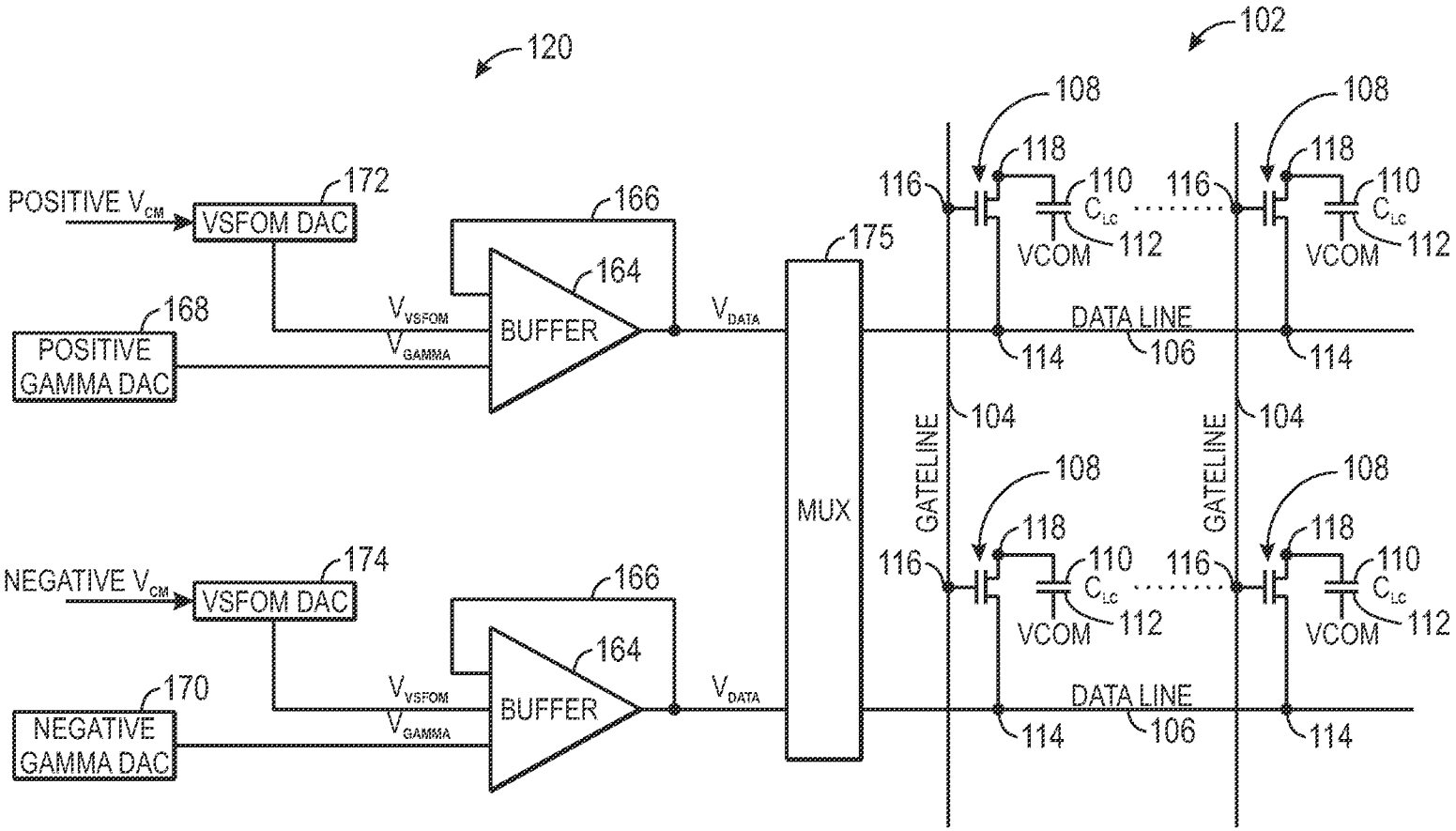
FIG. 7 is a block diagram of the source driver of FIG. 4 including respective positive and negative gamma DACs and VSFOM DACs, in accordance with an embodiment.

Indeed, as illustrated by FIG. 7, in certain embodiments, the source driver 120 may include a respective positive gamma DAC 168 and negative gamma DAC 170 and a respective positive VSFOM DAC 172 and negative VSFOM DAC 174 to respectively drive the positive polarity operation and the negative polarity operation of the unit pixels 102, and, by extension, the TFTs 108 of the display 18. Specifically, during operation of the display 18, when an electrical field generated between the pixel electrode 110 and the common electrode 112 (e.g., via the liquid crystal capacitance $C_{LC}$) is applied in the same direction continuously, the LC material (e.g., that may be positioned between the pixel electrode 110 and the common electrode 112) may suffer degradation over time. Thus, to prevent degradation of the LC material, the image data signals (e.g., $V_{DATA}$) provided to the unit pixels 102 may be driven by alternating voltage polarity, which may be referred to, for example, as line inversion, column inversion, or dot inversion. For example, the positive gamma DAC 168 may be used to generate positive gamma voltages (e.g., positive $V_{GAMMA}$), while the negative gamma DAC 170 may be used to generate negative gamma voltages (e.g., negative $V_{GAMMA}$).

In certain embodiments, as generally noted with respect to FIG. 6, the positive VSFOM DAC 172 and the negative VSFOM DAC 174 may include, for example, resistive DACs (e.g., R-DACs and/or R-2R DACs) and may receive respective positive and negative common mode voltage inputs (e.g., $V_{CM}$) as illustrated. In such an embodiment, the VSFOM DAC 162 may include a 6-bit DAC, an 8-bit DAC, a 10-bit DAC, or higher resolution DAC, which may include, for example, a resistor string that may generate reference voltages for each of the respective positive VSFOM DACs 172 and the negative VSFOM DAC 174 of the source driver 120 (e.g., column driver).

For example, in one embodiment, an 8-bit DAC including an 8-bit resistor string may be used since the respective positive VSFOM DACs 172 and the negative VSFOM DAC 174 are used to drive positive and negative polarity voltages. Specifically, as will be further appreciated, in such an embodiment, each channel may include, for example, a respective 3-bit or 7-bit VSFOM DAC 172 and negative VSFOM DAC 174, which may be provided to generate one or more voltages based on an n number of most significant bits (MSBs) (e.g., three (3) MSBs or other number of MSBs) of the gamma voltages generated by the positive gamma DAC 168 and negative gamma DAC 170.

For example, in some embodiments, the three (3) MSBs may include the voltage scaling factors to be applied to the respective positive and negative output buffers 164. The respective positive and negative output buffers 164 may then generate the output $V_{DATA}$ (e.g., $V_{GAMMA}+V_{VSFOM}$), which may be transmitted to a multiplexer (MUX) 175 used to switch between positive $V_{DATA}$ and negative $V_{DATA}$. The output $V_{DATA}$ (e.g., $V_{GAMMA}+V_{VSFOM}$) of the output buffer 164 may be used to drive the respective TFTs 108 to provide corrected image data to the respective pixel electrodes 110 when using, for example, line inversion, column inversion, and/or dot inversion driving technique. In this way, the positive VSFOM DACs 172 and the negative VSFOM DACs 174 may generate respective VSFOM voltage compensation values (e.g., $V_{VSFOM}$) to independently compensate for the voltage distortions (e.g., error voltages) that may become present on the pixel electrodes 110 as the display 18 is driven, for example, according to a line inversion, column inversion, and/or dot inversion driving technique.

In certain embodiments, as a further illustration of the present techniques, the voltage distortions (e.g., voltage errors) on the respective positively and negatively driven column pixels (e.g., column pixel electrodes 112) may be each generally expressed as:

$$V_{Error\ pos}=V_{OS\ pos}-K_{pos}\times V_{pixel} \quad \text{equation (1).}$$

$$V_{Error\ neg}=V_{OS\ neg}+K_{neg}\times V_{pixel} \quad \text{equation (2).}$$

In equations (1) and (2), $V_{OS\ pos}$ and $V_{OS\ neg}$ may represent, for example, offset voltage values corresponding to, and to be applied to the positive and negative output buffers 164. By way of example, in another embodiment, the offset voltage values $V_{OS\ pos}$ and $V_{OS\ neg}$ may be understood to represent the respective positive and negative offsets, or the difference between zero (e.g., nominally zero) and the actual value when a digital code for zero is applied to the VSFOM DACs 172 and 174. Likewise, $K_{pos}$ and $K_{neg}$ may respectively represent positive and negative scaling factor constants (e.g., gamma code constants) by which the voltage $V_{pixel}$ on the pixel electrodes 110 may be scaled to compensate for the voltage imbalance between the row and column pixels (e.g., row and column pixel electrodes 110) of the display 18. It should be appreciated that $V_{pixel}$ may be a function of the gamma voltages (e.g., $V_{GAMMA}$) generated by the positive gamma DACs 168 and negative gamma DACs 170, and may thus be adjusted and/or corrected by adjusting the gamma voltages (e.g., $V_{GAMMA}$) by the voltage compensation values (e.g., $V_{VSFOM}$). In a similar manner, VSFOM voltage compensation values (e.g., $V_{VSFOM}$) generated by the positive VSFOM DACs 172 and the negative VSFOM DACs 174 may be each generally expressed as:

$$V_{VSFOM\ pos}=V_{OS\ pos}-V_{Kpos} \quad \text{equation (3).}$$

$$V_{VSFOM\ neg}=V_{OS\ neg}+V_{Kneg} \quad \text{equation (4).}$$

Specifically, equations (3) and (4) illustrate that $V_{VSFOM\ pos}$ and $V_{VSFOM\ neg}$ voltage compensation values generated by the positive VSFOM DACs 172 and the negative VSFOM DACs 174 may be respectively based on a difference between the voltage offset values (e.g., difference in voltage) $V_{OS\ pos}$ and the positive scaling factor voltage $V_{Kpos}$ (e.g., positive gamma code) and a sum of the voltage offset value $V_{OS\ neg}$ and the negative scaling factor voltage $V_{Kneg}$ (e.g., negative gamma code). It should be appreciated that the positive scaling factor voltage $V_{Kpos}$ and the negative scaling factor voltage $V_{Kneg}$ may be respective products of the positive and negative scaling factor constants $K_{pos}$ and $K_{neg}$ and the pixel voltage $V_{pixel}$. For example, $V_{Kpos}$ and $V_{Kneg}$ may be generally expressed as:

$$V_{Kpos}=K_{pos}\times V_{pixel} \quad \text{equation (5).}$$

$$V_{Kneg}=K_{neg}\times V_{pixel} \quad \text{equation (6).}$$

As previously discussed above, in some embodiments, only the three (3) MSBs of the positive scaling factor voltage $V_{Kpos}$ (e.g., positive gamma code) and the negative scaling factor voltage $V_{Kneg}$ (e.g., negative gamma code) may be used by the respective positive VSFOM DACs 172 and negative VSFOM DACs 174 to generate voltage compensation values $V_{VSFOM\ pos}$ and $V_{VSFOM\ neg}$ to reduce, for example, the architectural area of the source driver 120. In this way, the respective positive VSFOM DACs 172 and negative VSFOM DACs 174 may compensate for voltage imbalance between the row and column pixels of the display 18 and/or between the column VCOM electrodes 156 and row VCOM electrodes 158, and thus the voltage distortions (e.g., error voltages) that may become present on the pixel electrodes 110 based thereon. Accordingly, the occurrence of mura artifacts on the display 18 may be reduced or substantially eliminated.

Figure 8:
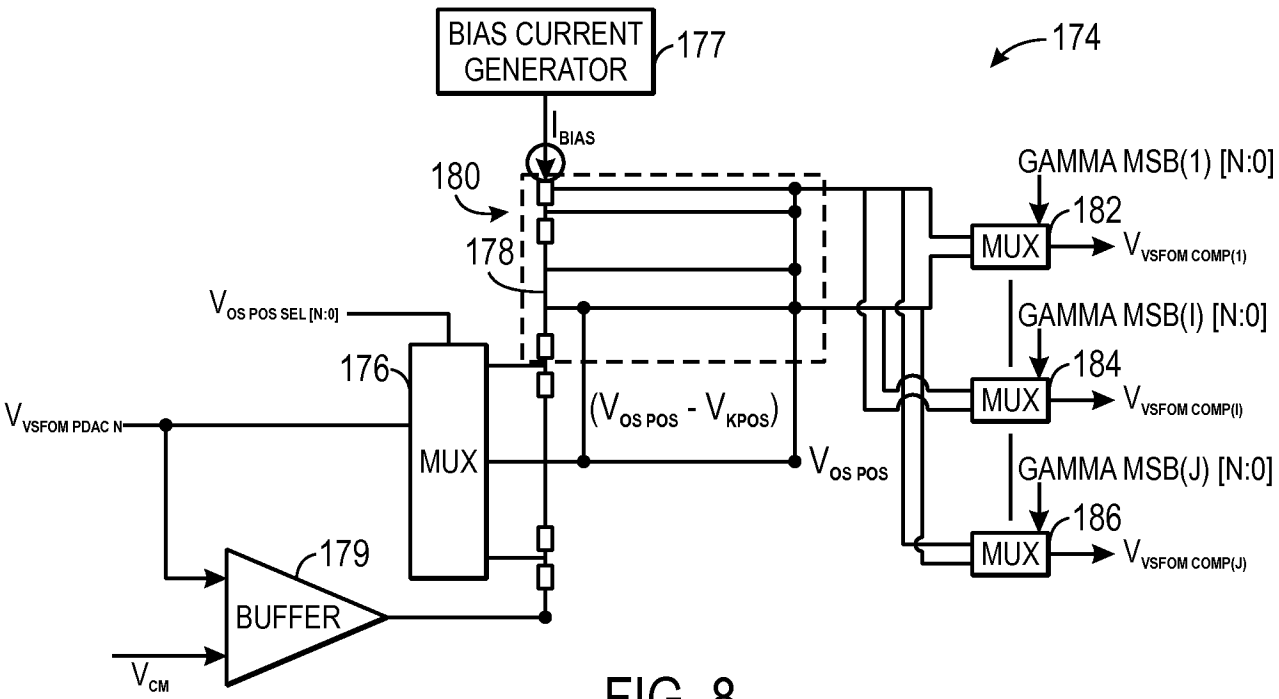
FIG. 8 is a block diagram of the positive VSFOM DAC of FIG. 7 including a component-level view of the positive VSFOM DAC, in accordance with an embodiment.
Figure 9:
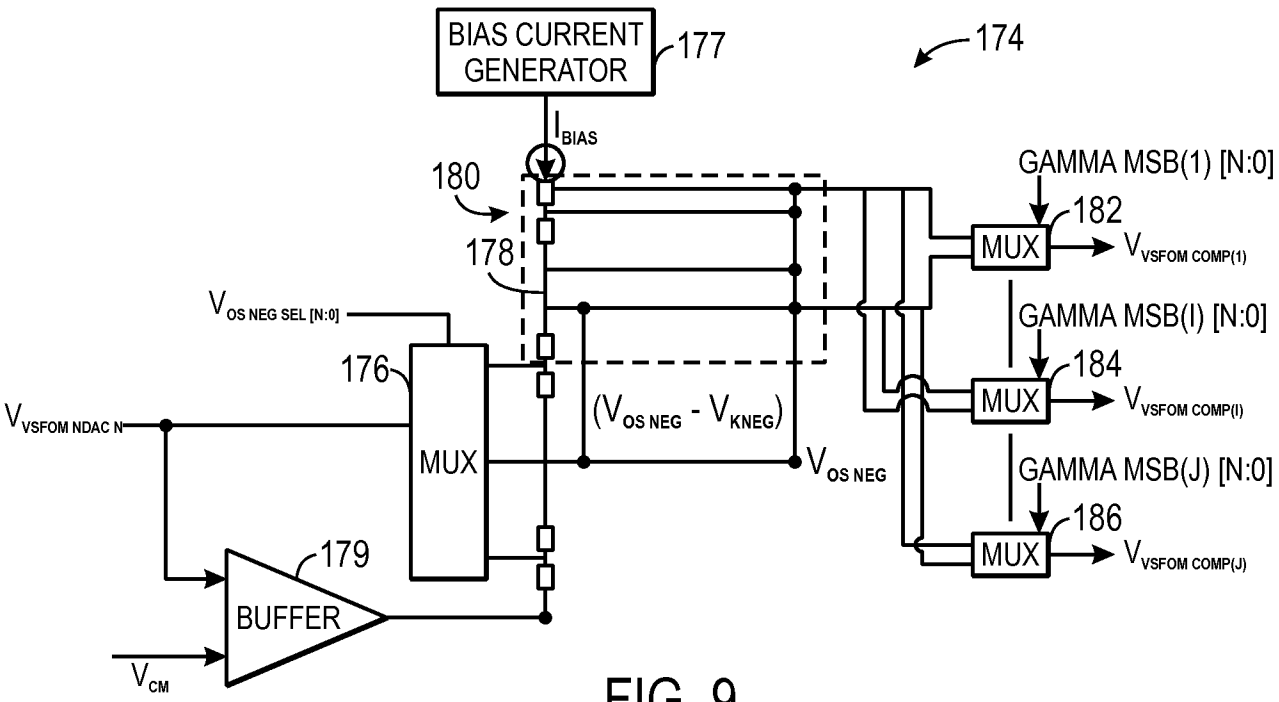
FIG. 9 is a block diagram of the negative VSFOM DAC of FIG. 7 including a component-level view of the negative VSFOM DAC, in accordance with an embodiment.

A further component-level illustration of the VSFOM DAC 162 of FIG. 6 (or the VSFOM DACs 172 and 174 of FIG. 7) in accordance with the present embodiments is presented in FIGS. 8 and 9. Specifically, FIG. 8 may be a component-level illustration of the positive VSFOM DAC 172, while FIG. 9 may be a component-level illustration of the negative VSFOM DAC 174. As depicted in FIG. 8, the positive VSFOM DAC 172, for example, may include a MUX 176 that may be used to generate an output $V_{VSFOM\ PDAC\ N}$ (e.g., a voltage indicative of the positive voltage imbalance between the row and column pixels) and receive an input $V_{OS\ pos\ SEL}$ (e.g., positive offset voltage selection bits). In some embodiments, the output $V_{VSFOM\ PDAC\ N}$ may include an n number of most significant bits (MSBs) (e.g., three (3) MSBs or other number of MSBs) of the positive gamma voltages generated, for example, by the positive gamma DAC 168.

Similarly, the input $V_{OS\ pos\ SEL}$ may be a programmable or adjustable value (e.g., 4-bit digital code or other n-bit digital code) that may be useful in offsetting an effect the pixel voltage (e.g., $V_{pixel}$) may have on the reference voltages or bias voltages generated by way of a resistor string 178 (e.g., resistor ladder or voltage ladder). Specifically, the MUX 176, in conjunction with the resistor string 178 may include a global master VSFOM DAC that may decode the output $V_{VSFOM\ PDAC\ N}$ and use the $V_{OS\ pos\ SEL}$ input (e.g., an n-bit binary code) to scale the reference and/or bias voltages and positive offset voltage $V_{OS\ pos}$ to be adjusted and outputted to one or more of the respective MUXs 182, 184, and 186 (e.g., local VSFOM DACs corresponding to each positively driven column data line 106). In one embodiment, the reference voltages across the resistor string 178 may include an indication of a presence of VSFOM.

As further illustrated, a buffer 179 (e.g., OpAmp) may be coupled to the resistor string 178 to provide a lower reference voltage signal to, for example, the lower tap or lower rail of the resistor string 178. In one embodiment, the lower reference voltage signal may substantially correspond to the common mode voltage input (e.g., $V_{CM}$) received by the buffer 179, or otherwise, may be based on the common mode voltage input (e.g., $V_{CM}$). The buffer 179 may also provide the positive offset voltage $V_{OS\ pos}$. In certain embodiments, as further illustrated, the output $V_{VSFOM\ PDAC\ N}$ of the MUX 176 may also serve as a feedback signal to the buffer 179. Specifically, as the MUX 176 may be coupled to one or more taps of the resistor string 178, and the buffer 179 may be used to provide common mode voltage (e.g., $V_{CM}$) to at least one of the taps of the resistor string 178, the voltage across the tap coupled to $V_{CM}$ may be different from the nominal voltage across the resistor string 178. Thus, the output signal $V_{VSFOM\ PDAC\ N}$ may be fed back to the buffer 179 to adjust the common mode voltage (e.g., $V_{CM}$) to be equal or substantially equal to the output signal $V_{VSFOM\ PDAC\ N}$.

In some embodiments, the resistor string 178 (e.g., resistor ladder), which may include a number of resistors connected in series, may be coupled to, and shared across each of the respective MUXs 182, 184, and 186. Particularly, in certain embodiments, the resistor string 178 may be used to provide substantially evenly distributed positive polarity reference voltages to the respective MUXs 182, 184, and 186 based on the outputs of the MUX 176. For example, the resistor string 178 may include $2^N$ resistors to provide voltages $V_1$ to $V_{2^N}$, in which N may represent the resolution of the image data in bits. By way of example, 6-bit image data may result in voltages $V_1$ to $V_{64}$, 8-bit image data may result in voltages $V_1$ to $V_{256}$, 10-bit image data may result in voltages $V_1$ to $V_{1024}$, and so forth.

In some embodiments, as further illustrated by FIG. 8, the positive VSFOM DAC 172 may include a bias current generator 177, which may be coupled to the upper tap or upper rail of the resistor string 178. As will be further appreciated, the bias current generator 177 may include an N-bit current DAC (e.g., 6-bit current DAC) useful in generating a programmable or adjustable bias current signal (e.g., $I_{bias}$) to calibrate or further adjust the reference and/or bias voltages across the resistor string 178. Specifically, the bias current generator 177 may generate the bias current signal (e.g., $I_{bias}$) to further adjust or scale the VSFOM DAC 172. That is, the bias current signal (e.g., $I_{bias}$) may be provided to further scale the reference voltages across the resistor string 178, and to tune the positive offset voltage $V_{OS\ pos}$ and the positive scaling factor voltage $V_{Kpos}$ for the effect of VSFOM. Furthermore, in one embodiment, a portion 180 of the resistor string 178 may be configured in such a manner that a resistor ratio, and, by extension, a voltage ratio of the portion 180 of the resistor string 178 may match the resistor ratio and voltage ratio of the portion of the positive gamma DAC 168 (e.g., R-DAC) corresponding to the specified n number of MSBs (e.g., 3 MSBs) of the positive gamma voltage $V_{GAMMA}$.

As further depicted by FIG. 8, one or more of the adjusted and/or scaled reference voltages across the resistor string 178 may be outputted to the respective MUXs 182, 184, and 186 (e.g., local VSFOM DACs corresponding to each positively driven column data line 106). While only three MUXs 182, 184, and 186 (and/or other selection devices 182, 184, and 186) are depicted, it should be appreciated that any number of selection devices (e.g., MUXs) may be provided. As illustrated, the MUXs 182, 184, and 186 may receive the adjusted and/or scaled reference voltage outputs from the resistor string 178. The MUXs 182, 184, and 186 (e.g., local VSFOM DACs corresponding to each column data line 106) may each then utilize the reference voltage outputs from the resistor string 178 in conjunction with a received n number of MSBs (GAMMA MSB (1)–GAMMA MSB (j)) (e.g., respective n-bit binary codes) of the positive gamma code (e.g., generated by the positive gamma DAC 168 as illustrated in FIG. 7) to generate respective positive compensation values ($V_{VSFOM\ Comp}(1)$–$V_{VSFOM\ Comp}(j)$).

Specifically, as illustrated in FIG. 8, the MUXs 182, 184, and 186 may each receive at least two reference voltage values from which to select between from the resistor string 178. The MUXs 182, 184, and 186 may then each output the respective positive VSFOM compensation values ($V_{VSFOM\ comp}(1)$–$V_{VSFOM\ Comp}(j)$) further scaled according to the received n number of MSBs (GAMMA MSB (1)–GAMMA MSB (j)) of the gamma voltages corresponding to the respective output buffers 164 and data lines 106.

Thus, the final compensation value $V_{VSFOM}$ (e.g., $V_{VSFOM\ pos}$ as previously discussed with respect to FIG. 7) may be the difference between the respective compensation values ($V_{VSFOM\ comp}(1)$–$V_{VSFOM\ Comp}(j)$ and the signal $V_{VSFOM\ PDAC\ N}$ (e.g., $V_{VSFOM\ Comp}$–$V_{VSFOM\ PDAC\ N}$). In another embodiment, because $V_{VSFOM\ PDAC\ N}$ may be equal to or substantially equal to the common mode voltage $V_{CM}$, the final compensation value $V_{VSFOM}$ (e.g., $V_{VSFOM\ pos}$) may be the difference between the respective compensation values ($V_{VSFOM\ Comp}(1)$–$V_{VSFOM\ Comp}(j)$ and $V_{CM}$ (e.g., $V_{VSFOM\ Comp}$–$V_{CM}$). The final compensation value $V_{VSFOM}$ (e.g., $V_{VSFOM\ pos}$) may be then output to, for example, the respective output buffers 164 to drive the corresponding data lines 106 (e.g., column data lines 106). In this way, the MUX 176 and resistor string 178 (e.g., the global master VSFOM DAC) in conjunction with the programmable bias current generator 177 and respective MUXs 182, 184, and 186 (e.g., local VSFOM DACs corresponding to each column data line 106) may generate a corrected positive image data output (e.g., $V_{DATA}$) to compensate for voltage imbalance between the row and column pixels of the display 18 and/or the voltage distortions (e.g., error voltages) that may have otherwise become present on the pixel electrodes 110. Thus, the occurrence of mura artifacts on the display 18 may be reduced and/or substantially eliminated.

Turning now to FIG. 9, which illustrates the negative VSFOM DAC 174. As it may be appreciated, the negative VSFOM DAC 174 may include substantially similar components as the positive VSFOM DAC 172. For example, the negative VSFOM DAC 174 may include a similar MUX 176 that may be used to generate an output $V_{VSFOM\ NDAC\ N}$ (e.g., a voltage indicative of the negative voltage imbalance between the row and column pixels) and receive an input $V_{OS\ neg\ SEL}$ (e.g., negative offset voltage selection bits). As similarly discussed with respect to the positive VSFOM DAC 172 of FIG. 8, the output $V_{VSFOM\ NDAC\ N}$ may include an n number of most significant bits (MSBs) (e.g., three (3) MSBs or other number of MSBs) of the negative gamma voltages generated, for example, by the negative gamma DAC 170.

Likewise, the input $V_{OS\ neg\ SEL}$ may be a programmable or adjustable value (e.g., 4-bit digital code or other n-bit digital code) that may be useful in offsetting an effect the pixel voltage (e.g., $V_{pixel}$) may have on the reference voltages or bias voltages generated by way of a similar resistor string 178. Specifically, as previously noted, the MUX 176, in conjunction with the resistor string 178 may include a global master VSFOM DAC that may decode the output $V_{VSFOM\ NDAC\ N}$ and use the $V_{OS\ neg\ SEL}$ input (e.g., an n-bit binary code) to scale the reference and/or bias voltages and negative offset voltage $V_{OS\ neg}$ to be outputted to one or more of the respective MUXs 182, 184, and 186 (e.g., local VSFOM DACs corresponding to each negatively driven column data line 106).

In certain embodiments, as similarly noted above with respect to FIG. 8, the output $V_{VSFOM\ NDAC\ N}$ of the MUX 176 may serve as a feedback signal to a similar buffer 179. Indeed, the MUX 176 may be coupled to one or more taps of the resistor string 178, and the buffer 179 may be used to provide common mode voltage (e.g., $V_{CM}$) to at least one of the taps of the resistor string 178. The voltage across the tap coupled to $V_{CM}$ may be different from the nominal voltage across the resistor string 178. Thus, the output signal $V_{VSFOM\ NDAC\ N}$ may be fed back to the buffer 179 to adjust the common mode voltage (e.g., $V_{CM}$) to be equal to or substantially equal to the signal $V_{VSFOM\ DAC\ N}$.

As further depicted in FIG. 9, a similar bias current generator 177 may generate the bias current signal (e.g., $I_{bias}$) to further adjust or scale the VSFOM DAC 174. Indeed, the bias current generator 177 may generate the bias current signal (e.g., $I_{bias}$) to further scale the reference voltages across the resistor string 178, and to tune the negative offset voltage $V_{OS\ neg}$ and the negative scaling factor voltage $V_{Kneg}$ for the effect of VSFOM. In one or more embodiments, a portion 180 of the resistor string 178 may be configured in such a manner that a resistor ratio, and, by extension, a voltage ratio of the portion 180 of the resistor string 178 may match the resistor ratio and voltage ratio of the portion of the negative gamma DAC 170 (e.g., R-DAC) corresponding to the specified n number of MSBs (e.g., 3 MSBs) of the negative gamma voltage $V_{GAMMA}$. The MUXs 182, 184, and 186 (e.g., local VSFOM DACs corresponding to each column data line 106) may each then utilize the adjusted and/or scaled reference voltage outputs from the resistor string 178 in conjunction with a received n number of MSBs (GAMMA MSB (1)–GAMMA MSB (j)) (e.g., respective n-bit binary codes) of the negative gamma code (e.g., generated by the negative gamma DAC 168 as illustrated in FIG. 7) to generate respective negative compensation values ($V_{VSFOM\ Comp}(1)$–$V_{VSFOM\ Comp}(j)$).

In certain embodiments, the MUXs 182, 184, and 186 may each receive at least two reference voltage values from which to select between from the resistor string 178. The MUXs 182, 184, and 186 may each then output the respective negative VSFOM compensation values ($V_{VSFOM\ Comp}(1)$–$V_{VSFOM\ comp}(j)$) further scaled according to the received n number of MSBs (GAMMA MSB (1)–GAMMA MSB (j)) of the gamma voltages. Thus, the final compensation value $V_{VSFOM}$ (e.g., $V_{VSFOM\ neg}$ as previously discussed with respect to FIG. 7) may be the difference between the respective compensation values ($V_{VSFOM\ Comp}(1)$–$V_{VSFOM\ Comp}(j)$ and the signal $V_{VSFOM\ NDAC\ N}$ (e.g., $V_{VSFOM\ Comp}$–$V_{VSFOM\ NDAC\ N}$). In another embodiment, because $V_{VSFOM\ NDAC\ N}$ may be equal to or substantially equal to the common mode voltage $V_{CM}$, the final compensation value $V_{VSFOM}$ (e.g., $V_{VSFOM\ neg}$) may be the difference between the respective compensation values ($V_{VSFOM\ Comp}(1)$–$V_{VSFOM\ Comp}(j)$ and $V_{CM}$ (e.g., $V_{VSFOM\ Comp}$–$V_{CM}$).

The final compensation value $V_{VSFOM}$ (e.g., $V_{VSFOM\ neg}$) may be then output to the respective output buffers 164 and data lines 106. Thus, as generally noted with respect to the positive VSFOM DAC 172 of FIG. 8, the MUX 176 and resistor string 178 (e.g., the global master VSFOM DAC) in conjunction with the programmable bias current generator 177 and respective MUXs 182, 184, and 186 (e.g., local VSFOM DACs corresponding to each column data line 106) may generate a corrected negative image data output (e.g., $V_{DATA}$) to compensate for voltage imbalance between the row and column pixels of the display 18 and/or the voltage distortions that may have otherwise become present on the pixel electrodes 110. In this manner, the occurrence of mura artifacts on the display 18 may be reduced and/or substantially eliminated.

Figure 10:
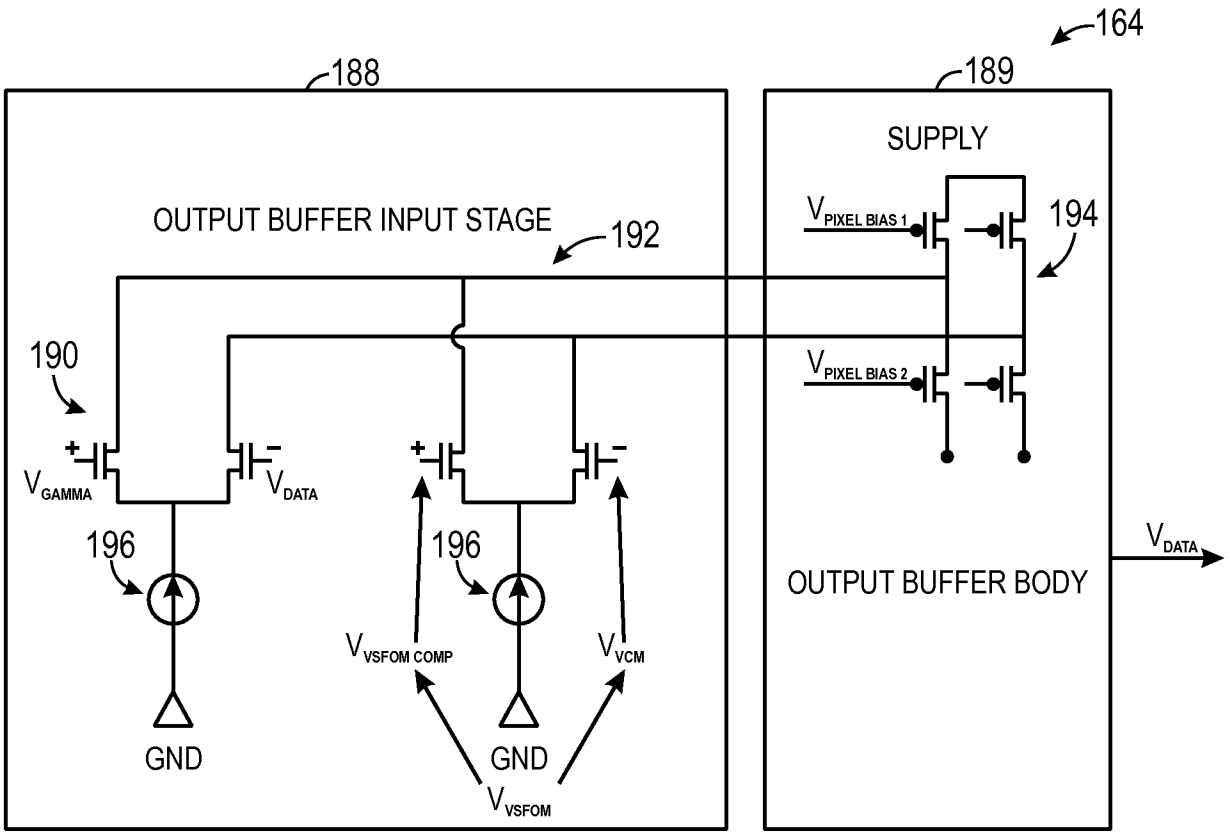
FIG. 10 is a component-level diagram of the output buffers included in FIG. 7, in accordance with an embodiment.

As a further illustration of the present techniques, FIG. 10 illustrates a component-level embodiment of the output buffer(s) 164 (e.g., as previously discussed with respect to FIG. 7). As depicted, the output buffer(s) 164 may include an input stage 188 and a body 189. The input stage 188 of the output buffer(s) 164 may include a first set of coupled transistors 190 (e.g., a first differential amplifier), in which the positive terminal may receive $V_{GAMMA}$ and the negative terminal may receive $V_{DATA}$ as previously discussed with respect to FIG. 7. In one embodiment, the negative terminal input $V_{DATA}$, as illustrated in FIG. 10, may represent a feedback signal, or, may represent $V_{DATA}$ before any adjustment for the effects of VSFOM.

Accordingly, to adjust for the effects of VSFOM, a second set of coupled transistors 192 (e.g., a second differential amplifier) may receive the respective compensation values (e.g., $V_{VSFOM\ Comp}$) at the positive terminal, and may receive $V_{CM}$ at the negative terminal. The second set of coupled transistors 192 (e.g., differential amplifier 192) may generate as an output (e.g., $V_{VSFOM}$) the voltage difference between $V_{VSFOM\ Comp}$ and $V_{CM}$ (e.g., $V_{VSFOM\ Comp}$–$V_{CM}$). As previously discussed above with respect to FIGS. 8 and 9, this value may be used to adjust $V_{DATA}$ for the effects of VSFOM. As further depicted, the first and second sets of coupled transistors 190 and 192 (e.g., differential amplifiers 190 and 192) may each include respective sources 196, and may be further coupled to supply circuitry 194. The supply circuitry 194 may receive respective pixel bias voltages (e.g., $V_{pixel\ bias\ 1}$ and $V_{pixel\ bias\ 2}$), and the outputs of the first and second sets of coupled transistors 190 and 192. As illustrated, the body 189 of the output buffer(s) 164 may then use these voltage values output $V_{DATA}$ (e.g., adjusted for the effects of VSFOM) to drive respective data lines 106.

Figure 11:
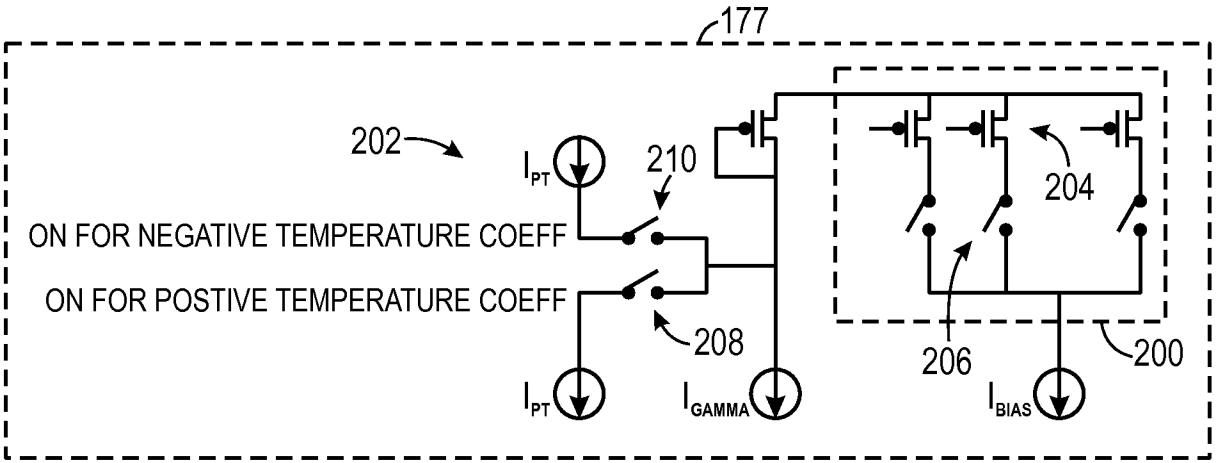
FIG. 11 is a component-level diagram of a bias current generator included in FIGS. 8 and 9 and including component-level views of a current DAC and temperature coefficient indication circuitry, in accordance with an embodiment.

As another example of the present techniques, FIG. 11 illustrates a component-level (e.g., analog component level) embodiment of the bias current generator 177 discussed with respect to FIGS. 8 and 9. As depicted, the bias current generator 177 may include a current DAC 200, which may, in some embodiments, be electrically coupled to temperature coefficient indication circuitry 202. Respective current DAC(s) 200 may be used to scale the positive and negative VSFOM DACs 172 and 174 to adjust for the effect of VSFOM. In certain embodiments, the current DAC 200 may be programmable or adjustable. For example, as further illustrated in FIG. 10, the current DAC 200 may include a number of active switching devices 204 (e.g., positive-channel metal-oxide-semiconductor (PMOS) transistors or other transistors) and passive switches 206. The active switching devices 204 and passive switches 206 may collectively include an N weighted and/or N-bit (e.g., 6-bit) current source used to control and adjust the bias current (e.g., $I_{bias}$) according to the presence of VSFOM, and as the bias current (e.g., $I_{bias}$) is output to, for example, the resistor string 178. In one embodiment, the bias current (e.g., $I_{bias}$) may be toggled or programmed based on, for example, a positive and/or negative temperature coefficient detected, for example, via the temperature coefficient indication circuitry 202.

Indeed, in some embodiments, a temperature characteristic of the presence of VSFOM may be detected based on, for example, a weighted value of gamma DAC 160 current (e.g., $I_{GAMMA}$) and temperature coefficient current (e.g., $I_{pt}$) (e.g., a ratio of increased resistance per degree rise in temperature) associated with the gamma DAC 160. Specifically, based on one or more characteristics of the gamma current (e.g., $I_{GAMMA}$), the temperature characteristic of the VSFOM that may become present on the display 18 may be detected and learned during manufacturing of the display 18. For example, in certain embodiments, the gamma current (e.g., $I_{GAMMA}$) may be inversely proportional to resistance (e.g., resistance across the resistor sting of the gamma DAC 160), such that the gamma voltage (e.g., $V_{GAMMA}$) may be independent of temperature. Similarly, the positive temperature coefficient current (e.g., $I_{pt}$) or negative temperature coefficient (e.g., $I_{nt}$) may be generated via a bandgap voltage generator (although not illustrated) that may be coupled to one or more components of the current DAC 200 or the temperature coefficient indication circuitry 202.

Thus, in certain embodiments, the VSFOM DAC (e.g., VSFOM DAC 162) may utilize the combination of the different weighted values of gamma DAC 160 current (e.g., $I_{GAMMA}$) and temperature coefficient (e.g., $I_{pt}$, $I_{nt}$) to generate a desired temperature coefficient (e.g., $\alpha_{VSFOM}$) generated to provide further control of the bias current (e.g., $I_{bias}$) output to, for example, the resistor string 178. As illustrated, positive and negative temperature coefficient switches 208 and 210 may toggle according to the polarity of the desired temperature coefficient (e.g., $\alpha_{VSFOM}$), and may thus provide a signal (e.g., one or more control bits) to the active switching devices based on the polarity of the desired temperature coefficient (e.g., $\alpha_{VSFOM}$). In this way, VSFOM that may become present on the display 18 may be more accurately compensated for because the VSFOM DAC 162 may detect a presence of VSFOM based on, for example, the different weighted values of the gamma DAC 160 current (e.g., $I_{GAMMA}$) and temperature coefficient (e.g., $I_{pt}$, $I_{nt}$) once the temperature characteristic of VSFOM has been learned.

Figure 12:
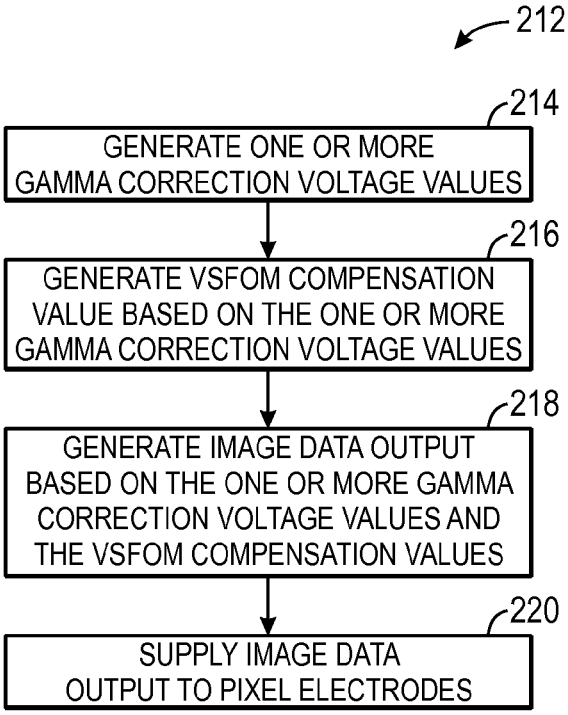
FIG. 12 is a flowchart illustrating an embodiment of a process suitable for reducing or eliminating mura artifacts (VSFOM) by using DAC based techniques, in accordance with an embodiment.

Turning now to FIG. 12, a flow diagram is presented, illustrating an embodiment of a process 212 useful in reducing and/or substantially eliminating mura artifacts (e.g., VSFOM) on an electronic display by using, for example, the one or more processor(s) 12 included within the system 10 depicted in FIG. 1. The process 212 may include code or instructions stored in a non-transitory machine-readable medium (e.g., the memory 14) and executed, for example, by the one or more processor(s) 12 and/or the source driver 120 included within the system 10 and illustrated in FIG. 4. The process 212 may begin with the source driver 120 generating (block 214) one or more gamma correction voltages. For example, the gamma DAC 160 and/or the positive and negative gamma DACs 168 and 170 of the source driver 120 may generate one or more gamma correction voltages (e.g., $V_{GAMMA}$) used to compensate for the nonlinear transmittance-voltage characteristics of the display 18 by adjusting the image data signal 122.

The process 212 may continue with the source driver 120 generating (block 216) a VSFOM compensation value based on the one or more gamma correction codes. For example, as noted above with respect to FIGS. 6 and 7, the VSFOM DAC 162 and/or the positive and negative VSFOM DACs 172 and 174 of the source driver 120 may generate one or more VSFOM compensation voltage values (e.g., $V_{VSFOM}$) scaled according to, for example, an n number of MSBs (e.g., three (3) MSBs) of the one or more gamma correction voltages.

The process 212 may then continue with the source driver 120 generating (block 218) a corrected image data output based on the one or more generated gamma correction values and the generated VSFOM compensation value. Specifically, the output buffer 164 of the source driver 120 may be used to sum the gamma voltage (e.g., $V_{GAMMA}$) and the VSFOM voltage compensation value (e.g., $V_{VSFOM}$) to generate a corrected image data output signal $V_{DATA}$ (e.g., $V_{GAMMA}+V_{VSFOM}$). The process 212 may then conclude with the source driver 120 supplying (block 220) the image data output to the pixel electrodes (e.g., pixel electrodes 110) of the display 18.

For example, the output buffer 164 of the source driver 120 may be used to drive the data line 106, and, by extension, provide the image data output signal $V_{DATA}$ to the respective TFTs 108 to provide corrected image data to the respective pixel electrodes 110. Specifically, the source driver 120 may supply an image data signal that has been adjusted and/or corrected to compensate for voltage imbalance (e.g. difference in voltage) between the row and column pixels of the display 18 and/or voltage distortions (e.g., error voltages) that may have otherwise become present on the pixel electrodes 110. Accordingly, the source driver 120, and more specifically, the VSFOM DACs may be provided to reduce or eliminate the occurrence of mura artifacts that may otherwise become apparent on the display 18.

Figure 13:
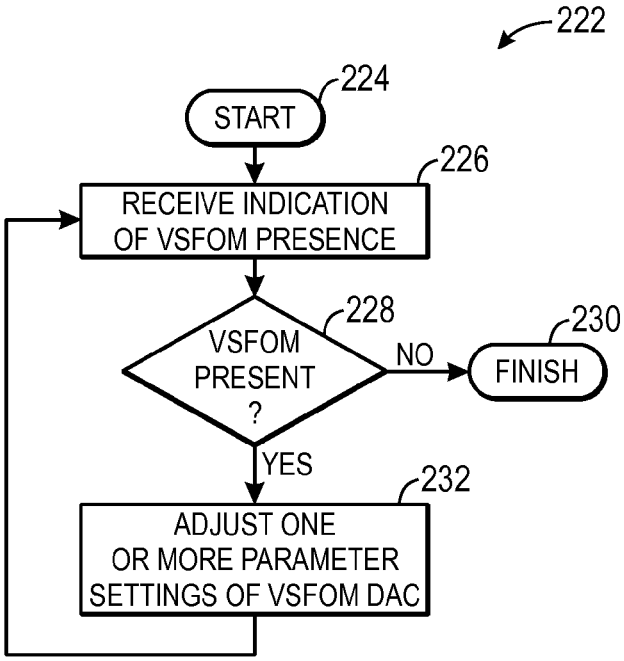
FIG. 13 is a flowchart illustrating an embodiment of a process suitable for detecting and reducing an occurrence mura artifact (VSFOM), in accordance with an embodiment.

In a similar manner, FIG. 13 depicts another flow diagram, illustrating an embodiment of a process 222 useful in reducing and/or substantially eliminating mura artifacts (e.g., vertical stripe features of merit (VSFOM)) on an electronic display by detecting and compensating for a presence of VSFOM using the one or more processor(s) 12 and/or the source driver 120 included within the system 10 depicted in FIG. 4. It should be appreciated that the process 222 may be performed during, for example, a design stage of the display 18, a manufacturing stage of the display 18, a quality testing stage of the display 18, or during some other time in which the presence of VSFOM may be detected and reduced or eliminated. The process 222 may include code or instructions stored in a non-transitory machine-readable medium (e.g., the memory 14) and executed, for example, by the one or more processor(s) 12 and/or the source driver 120 included within the system 10 and illustrated in FIG. 4.

The process 222 may begin (start 224) with the one or more processor(s) 12 and/or the source driver 120 receiving (block 226) an indication of VSFOM presence. As previously noted, VSFOM, or an operating condition conducive to an occurrence of VSFOM, may be detected based on, for example, the voltage imbalance between the row and column pixels of the display 18 and/or a voltage difference detected between the column VCOM electrodes 156 and row VCOMs electrodes 158. In another embodiment, a temperature characteristic of the presence of VSFOM may be detected based on, for example, a weighted value of gamma DAC 160 current (e.g., $I_{GAMMA}$) and temperature coefficient current (e.g., $I_{pt}$, $I_{nt}$) associated with the gamma DAC 160. Based on one or more characteristics of the current $I_{GAMMA}$ and the temperature coefficient current (e.g., $I_{pt}$, $I_{nt}$), VSFOM may be detected.

The process 222 may continue with the one or more processor(s) 12 and/or the source driver 120 determining (decision 228) whether VSFOM is present (e.g., based on the detection techniques as discussed with respect to block 210). If VSFOM is present, the process 222 may continue with the one or more processor(s) 12 and/or the source driver 120 adjusting (block 232) one or more parameter settings of the one or more VSFOM DACs of the source driver 120. For example, as noted above, the programmable bias current signal (e.g., $I_{bias}$) or the programmable $V_{OS\ SEL}$ input (e.g., an n-bit binary code) may be adjusted to adjust or scale the VSFOM DAC (e.g., VSFOM DAC 162). More specifically, the programmable bias current signal (e.g., $I_{bias}$) or the programmable $V_{OS\ SEL}$ input (e.g., an n-bit binary code) may be adjusted to further scale the reference voltages across the resistor string 178, and to tune the offset voltage and scaling factor voltage parameters $V_{OS\ pos}$, $V_{OS\ neg}$, $V_{Kpos}$, and $V_{Kneg}$ for the effect of VSFOM. If VSFOM is not present, the process 222 may conclude (finish 230).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising:

a display panel, comprising:

a plurality of pixels comprising pixel electrodes configured to receive an image data signal;

a plurality of common electrodes (VCOMs) configured to receive a common voltage signal, gather touch sense information when operating in a touch mode, and enable the plurality of pixels to display an image based at least in part on the image data signal when operating in a display mode, wherein the plurality of VCOMs comprises a column VCOM comprising a first resistance value and a row VCOM comprising a second resistance value; and a gate driver configured to provide an activation signal to the plurality of pixel electrodes; and a source driver, comprising:

a first digital to analog converter (DAC) configured to generate a gamma voltage signal to provide a first adjustment to the image data signal;

a second DAC configured to generate an error correction voltage signal to provide a second adjustment to the image data signal, wherein the second adjustment is configured to adjust the image data signal to compensate for a voltage imbalance due at least in part to a difference in resistance between the first resistance value of the column VCOM and the second resistance value of the row VCOM; and an output buffer configured to supply the image data signal to the plurality of pixel electrodes, wherein the image data signal comprises the first adjustment and the second adjustment.

2. The electronic device of claim 1, wherein the first DAC is configured to generate a first gamma correction value corresponding to a positive image data signal and second gamma correction value corresponding to a negative image data signal.

3. The electronic device of claim 1, wherein the second DAC is configured to generate a first voltage error compensation value corresponding to a positive image data signal and second voltage error compensation value corresponding to a negative image data signal, and wherein the first and the second voltage error compensation values are configured to reduce or substantially eliminate an occurrence of mura artifacts on the display panel.

4. The electronic device of claim 1, wherein the output buffer is configured to sum the gamma voltage signal and the error correction voltage signal to supply the image data signal.

5. The electronic device of claim 1, wherein the output buffer is configured to generate the image data signal based at least in part on a combination of a characteristic of the gamma voltage signal and the error correction voltage signal.

6. The electronic device of claim 1, wherein:

the first DAC comprises gamma correction circuitry configured to provide a first set of signals comprising a plurality of gamma codes;

the first adjustment is based at least in part on at least one gamma code of the plurality of gamma codes;

the second DAC comprises:

a primary multiplexer configured to generate a first set of voltage values corresponding to the at least one gamma code;

a resistor string coupled to the primary multiplexer and configured to receive the first set of voltage values and to provide a second set of reference voltage values based thereon; and a plurality of secondary multiplexers each configured to receive a subset of the second set of reference voltage values and the at least one gamma code, wherein the plurality of secondary multiplexers is configured to provide a second set of signals; and the second adjustment is based at least in part on the second set of signals.

* * * * *